US009416491B2

(12) United States Patent
Vesala et al.

(10) Patent No.: US 9,416,491 B2
(45) Date of Patent: Aug. 16, 2016

(54) METHOD OF AND AN ARRANGEMENT FOR TRANSFERRING A PROCESS LIQUID, AN INDUSTRIAL FACILITY AND A METHOD OF SIMPLIFYING THE LAYOUT OF SUCH

(71) Applicant: Sulzer Pumpen AG, Winterthur (CH)

(72) Inventors: Reijo Vesala, Kotka (FI); Vesa Vikman, Kotka (FI)

(73) Assignee: Sulzer Management AG, Winterthur (CH)

( * ) Notice: Subject to any disclaimer, the term of this patent is extended or adjusted under 35 U.S.C. 154(b) by 0 days.

(21) Appl. No.: 14/146,599

(22) Filed: Jan. 2, 2014

(65) Prior Publication Data

US 2014/0190643 A1 Jul. 10, 2014

(30) Foreign Application Priority Data

Jan. 4, 2013 (EP) ..... 13150283

(51) Int. Cl.

| | |
|---|---|
| ***D21C 9/02*** | (2006.01) |
| ***D21C 7/08*** | (2006.01) |
| ***F04D 7/04*** | (2006.01) |
| *D21F 1/06* | (2006.01) |

(52) U.S. Cl.

CPC .. *D21C 9/02* (2013.01); *D21C 7/08* (2013.01); *F04D 7/045* (2013.01); *D21F 1/06* (2013.01); *Y10T 29/49716* (2015.01)

(58) Field of Classification Search

CPC ..... D21C 9/02

See application file for complete search history.

(56) References Cited

U.S. PATENT DOCUMENTS 3,096,234 A 7/1963 Armstrong
2005/0224198 A1* 10/2005 Snekkenes ..... D21F 1/74 162/17
2009/0288789 A1* 11/2009 Sabourin ..... D21B 1/021 162/24
2010/0258257 A1* 10/2010 Leinonen ..... F04D 15/0218 162/49
2011/0005696 A1* 1/2011 Danielsson ..... D21C 9/02 162/1

FOREIGN PATENT DOCUMENTS

EP 0 323 749 A2 7/1989
WO 2009/037091 A1 3/2009

OTHER PUBLICATIONS

Andritz, Andritz Medium Consistency Pumps SF series, 2007, downloaded online Apr. 4, 2012, downloaded from pdf.directindustry.com.*

Gullichsen editor, Chemical Pulping 6A, 1999, Fapet Oy,p. 594-600.*

Berthold Technologies, Non-Contact Continuous Level MC Pump Standpipes (downloaded online May 1, 2015), publication date Feb. 27, 2011 or earlier.*

Metso, Medium Consistency Flow Control Valves, Oct. 2011.*

European Search Report mailed Jul. 18, 2013 in Application No. 13150283.3.

* cited by examiner

*Primary Examiner* — Anthony Calandra

(74) *Attorney, Agent, or Firm* — Kilpatrick Townsend & Stockton LLP

(57) ABSTRACT

The present invention relates to a method of and an arrangement for transferring a process liquid from a washing and thickening device to a subsequent process stage. In accordance with an advantageous embodiment of the present invention, the method and the arrangement are applicable, for example, in transferring fibre suspensions or pulps from washing and thickening device to a subsequent process stage in pulp and paper making industry such that the dilution of pulp after a washing and thickening device is performed in a stand pipe (18) below the surface level control range.

7 Claims, 4 Drawing Sheets

METHOD OF AND AN ARRANGEMENT FOR TRANSFERRING A PROCESS LIQUID, AN INDUSTRIAL FACILITY AND A METHOD OF SIMPLIFYING THE LAYOUT OF SUCH

This application claims the priority of European Patent Application No. 13150283.3 filed Jan. 4, 2013, the disclosure of which is incorporated herein by reference.

TECHNICAL FIELD

The present invention relates to a method of and an arrangement for transferring a process liquid from a washing and thickening device to a subsequent process stage, an industrial facility and a method of simplifying the layout of such. In accordance with an advantageous embodiment of the present invention, the method and the arrangement are applicable, for example, in transferring fibers suspensions or pulps from a washing and thickening device to a subsequent process stage in pulp and paper making industry and for simplifying the layout of a pulp mill.

BACKGROUND ART

As examples of prior art methods and arrangements for transferring a process liquid between washing and thickening device and subsequent treatment stages, a few practical cases from pulp and paper industry will be discussed in the following. However, already at this stage it should be understood that similar processes exist, not only in pulp and paper industry, but also in several other industries like applications, for instance, in biomass processes and in the manufacture of biofuel.

A good example of the problem areas in pulp and paper industry are various washing and thickening stages, or washing and thickening device between the digestion of wood chips in chemical pulping and the web formation at a pulp or paper mill. Such means are needed, for instance in so called brown stock washing and in various washing stages when delignifying and bleaching the pulp. In pulp and paper making industry various different washing, filtering and thickening device are used. A first example of such is a single or multistage drum washer from which pulp is discharged at a consistency of 10-18%. Usually the pulp is discharged from such a washer by means of a discharge screw into a stand pipe or a feed chute such that the pulp is diluted in the discharge screw down to a consistency of 8-15%, which is the consistency of the pulp transferred further by means of a centrifugal pump from the bottom part of the stand pipe. In other words, most of the washing and filtering means presently in use are able to raise the consistency of the pulp to such an area that the pulp has to be diluted so that pulp could be fed to the next process stage (including also web formation or storage tower) by means of a state-of-the-art centrifugal pump or a fluidizing centrifugal pump though also positive displacement pumps may be used.

The stand pipe or feed chute is typically an upright vessel having a height of 5-7 meters. When the height required by the dilution means, possibly extending to several meters, is taken into account, the height at which the washing and thickening device are to be installed, for ensuring a sufficient height for the stand pipe and dilution, easily exceeds 10 meters. It means that the washing and thickening device is arranged one or two storeys or floor levels higher than the pump used for discharging the stand pipe. In fact, this is the main reason why pulp mills e.g. in bleaching plants need to have a second floor, or possibly a third floor, too, above the ground floor. In other words, the washing and thickening device must have been raised and supported some 6 to 15 meters above the ground floor for ensuring trouble-free pumping of pulp from the washing stage to a subsequent process stage. One reason why such high stand pipes are needed is the fluctuation in the discharge or production rate of the washing and thickening device. Such fluctuation may originate not only from the uneven operation of the discharge/dilution screw/s but also from the fluctuations in the production rate of the earlier treatment or process devices upstream of the washing and thickening device. For the above reason the stand pipe is used as a buffer tank whereby the level of the pulp in the stand pipe is measured and maintained within certain desired limits, i.e. between the upper and lower limits of the surface level control range. It is also, however, ensured that both the pump at the bottom part of the stand pipe and the washing and thickening device upstream of the stand pipe function without disturbance. This means, in practice, that the pulp should have enough residence time (meaning height) in the stand pipe so that pulp surface could be easily maintained between the allowable upper and lower limits.

Another good example of washing and thickening device, or, more generally, process devices is a wash press from which the pulp is discharged at a consistency of 20-40%, sometimes even at a consistency of up to 50%. Typically the discharge screw of a wash press is at the top part of the wash press (several meters (structural height of the wash press) above the floor on which the wash press is installed) such that the discharge screw moves the thickened fibre suspension from the wash press to a dilution means arranged to the same level, floor or storey with the wash press. In the dilution means the consistency of the washed and/or thickened fibre suspension is decreased down to 8-15%, too. The dilution means discharge the pulp to a stand pipe similar to the one discussed already above.

The dilution of pulp or fibre suspension after the washing and thickening device may be performed by means of the discharge screw of the washing and thickening device, by means of a separate dilution screw or by means of a separate mechanical dilution apparatus or the dilution means may be one or more dilution liquid conduits or nozzles arranged, in practice, immediately after the discharge screw of the washing and thickening device or the dilution may be performed at the top of the stand pipe. Thus the pulp is, in all prior art applications, diluted in advance of its entrance on the pulp column in the stand pipe or feed chute.

A further prior art example relating to transferring pulp from a washing and thickening device to a subsequent process stage by means of first diluting the pulp to a lower consistency and then pumping the pulp is discussed in the following. In accordance with this example the thickened pulp is discharged from the thickening washing means at a high consistency to the stand pipe such that the pulp is diluted in the pumping consistency substantially simultaneously with its entrance in the stand pipe. However, the bottom part of the stand pipe is, for safety reasons, provided with additional liquid introduction means, which are used for injecting liquid, normally, water into the pulp. These introduction means are used in such a case that the pump is, for some reason (e.g. non-homogenous dilution), not able to pump the diluted pulp properly without the additional dilution. However, the purpose of feeding the additional dilution liquid to the bottom part of the stand pipe is to adjust the consistency of pulp momentarily to a lower value, i.e. of the order of 2 percentage units or less lower (for instance from 12% to 10%) for ensuring the continuous operation of the pump by reducing the head requirement or reducing flow resistances in the discharge piping. However, such a dilution means is not intended for continuous operation, and it is not constructed to homogenize the consistency of the fibre suspension at the bottom part of the stand pipe, i.e. the means introducing the dilution liquid are not arranged to spread the dilution liquid to the cross section of the stand pipe.

In the following various problems encountered in the above discussed prior art arrangements are discussed.

The building where the washing and thickening device are located requires one or two storeys above the ground floor for ensuring a sufficient height for the dilution of the pulp and the stand pipe with its surface level control arrangements.

The dilution performed immediately after the washing and thickening device is not necessarily even or uniform but a part of the thick pulp and a part of the dilution liquid may enter the stand pipe without substantial mixing whereby the final mixing of the pulp and dilution liquid is performed by the pump discharging pulp from the bottom of the stand pipe.

Due to the location of the washing and thickening device at a height of one or two storeys or floors a pump is normally needed for feeding pulp to the washing and thickening device.

Since the pulp is diluted at such an early phase that the pulp column or layer in the stand pipe is of diluted pulp it is clear that the height of the level control range has to be substantially high to maintain a required pulp volume in the stand pipe. Increasing the diameter of the stand pipe or feed chute cannot be considered a preferred way of maintaining the control volume the same even if the height of the control range is decreased, as increasing the diameter of the stand pipe changes rapidly the flow conditions in the stand pipe. The pulp in the stand pipe starts easily to channel, which means that a part of the pulp column in the stand pipe remains in place whereas the rest of the column flows rapidly along "a channel" down to the pump. The standing part of the pulp may start to dewater and to filter, i.e. to dry due to gravity. It may also start to decay. In both cases parts of the standing pulp may loosen from the pulp column, and be pumped further, where they possibly reduce dramatically the quality of the end product. Also, the loosened parts of the standing pulp have a consistency significantly higher than that of the pulp normally flowing to the pump, whereby the loosened parts, depending on their size, may make the consistency of the pumped pulp fluctuate significantly.

BRIEF SUMMARY OF THE INVENTION

Thus, an object of the present invention is to develop a novel method of and an arrangement for transferring a process liquid from washing and thickening device to a subsequent process stage such that at least one of the above mentioned and/or other problems is solved.

Another object of the present invention is to develop a novel method of and an arrangement for transferring a process liquid such that the washing and thickening device could be arranged at a lower level, preferably on the ground floor of the process building, whereby substantial savings in construction costs are gained.

A further object of the present invention is to develop a novel method of and an arrangement for transferring a process liquid such that substantial energy savings are gained due to reduced need of pumping the process liquid.

A still further object of the present invention is to suggest a novel lay-out for a mill where the washing and thickening device and the stand pipe are arranged on the same floor without a need to construct additional levels, floors or storeys for the washing and thickening device.

Thus, the objects of the present invention also cover various ways to construct the washing and thickening device—stand pipe combination such that the washing and thickening device may be arranged on the same floor with the stand pipe.

In order to solve, at least one of the prior art problems, the method of transferring a process liquid from washing and thickening device to a subsequent process stage, the method comprising the steps of:

Discharging the process liquid in a first consistency from the washing and thickening device, Taking the process liquid to a stand pipe, Diluting the process liquid to a second consistency, i.e. to an MC-consistency, Providing the stand pipe with means for measuring the surface level of the process liquid in the stand pipe, the measuring means having a surface level control range with an upper surface level control limit, and a lower surface level control limit for maintaining, when in use, the surface level of the process liquid between the upper and the lower surface level control limits, Discharging the process liquid in the second consistency from said stand pipe by means of a pump arranged in flow communication with a discharge outlet opening provided in the stand pipe, further comprises the step of Providing the process liquid in the surface level control range in the stand pipe with an average consistency, i.e. a third consistency, the third consistency being at least 1,5 times the second consistency.

For the same purpose the arrangement for transferring a process liquid from washing and thickening device to a subsequent process stage, the arrangement comprising a washing and thickening device from which the process liquid is discharged at a first consistency, means for diluting the process liquid, a stand pipe to which the process liquid is discharged, means for measuring surface level of the process liquid in the stand pipe, a discharge outlet opening for discharging diluted process liquid from the stand pipe, a pump arranged in flow communication with the discharge outlet opening for transferring the process liquid further in a second consistency, the measuring means being provided with a surface level control range having an upper surface level control limit and a lower surface level control limit, is provided with diluting means comprising means for spreading and feeding dilution liquid to the cross section of the stand pipe in communication with the process liquid, the diluting means being positioned and dimensioned such that the average consistency of the process liquid in the surface level control range, i.e. a third consistency, is at least 1.5 times the second consistency.

Also for solving some of the prior art problems the present invention discusses an industrial facility having at least one tower for treating a process liquid, and a washing and thickening device for washing and thickening the process liquid, the washing and thickening device being supported on the same floor BF with the tower.

And finally, again for solving at least one of the prior art problems the present invention discusses a method of simplifying the layout of an industrial facility used for treating a process liquid in at least two successive process steps, the industrial facility having a washing and thickening device with a structural height, where washing and thickening is performed, and a stand pipe used for transferring the process liquid from the washing and thickening device to a subsequent process stage , the method comprising the step of performing at least one of Taking the structural height of the washing and thickening device in use, Arranging the introduction of the process liquid from the washing and thickening device to the stand pipe by means of an upwardly inclined feeding means, and Reducing the height of required surface level control range in the stand pipe, for bringing the washing and thickening device at a lower level in the industrial facility.

Other characteristic features of the method and the arrangement of the present invention are disclosed in the appended patent claims.

With the present invention it is also possible to arrange a washing stage, a thickening stage or a bleaching stage or the entire fibre line into a lower building without a need of several storeys.

BRIEF DESCRIPTION OF DRAWING

In the following, the method and the arrangement of the present invention are discussed in more detail with reference to the appended figures, in which.

DETAILED DESCRIPTION OF DRAWINGS

Figure 1:
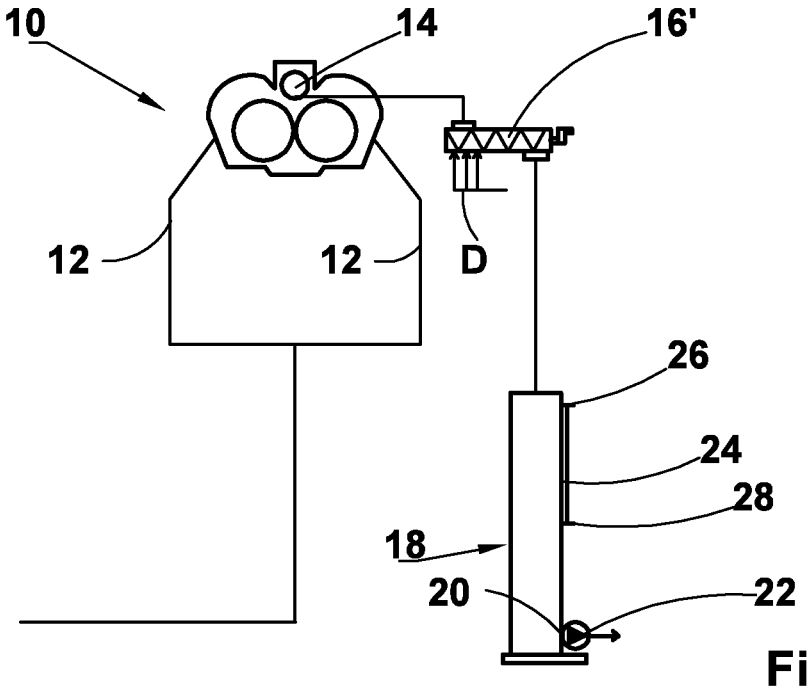
FIG. 1 illustrates a prior art arrangement for transferring pulp from a washing and thickening apparatus to a stand pipe.
Figure 2:
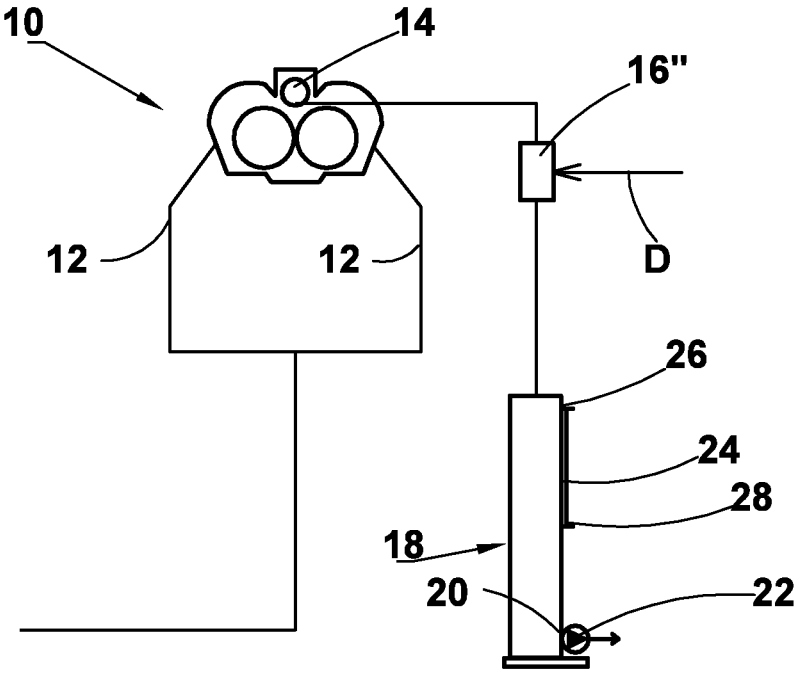
FIG. 2 illustrates another prior art arrangement for transferring pulp from a washing and thickening apparatus to a stand pipe.
Figure 3:
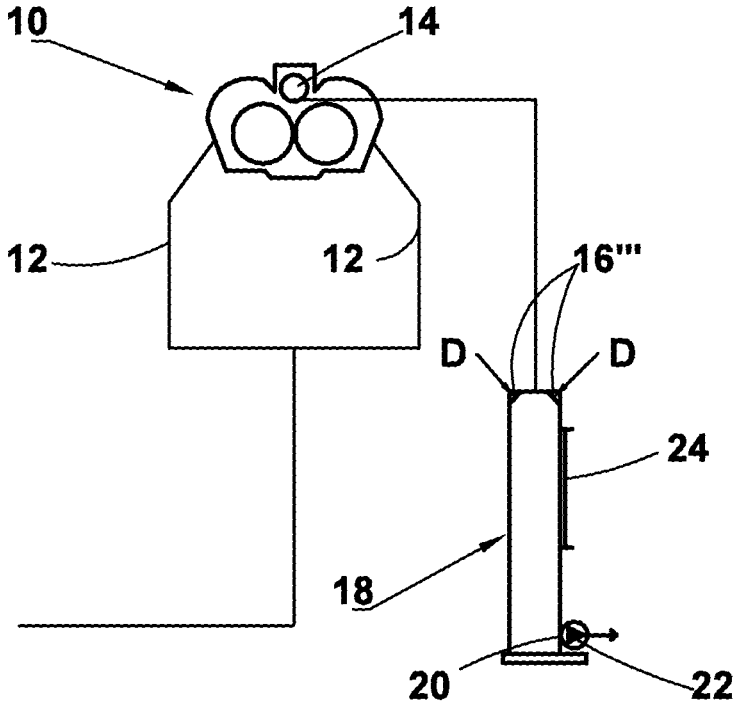
FIG. 3 illustrates yet another prior art arrangement for transferring pulp from a washing and thickening apparatus to a stand pipe.

FIGS. 1, 2 and 3 illustrate as examples of prior art arrangements for transferring a process liquid from washing and thickening device to a subsequent process stage two wash press—stand pipe combinations (FIGS. 1 and 2) of a pulp mill, where pulp is discharged from the washing and thickening device, i.e. the wash press 10 at a consistency of 20-50%, is diluted 16', 16" to a consistency of 8-14% and is discharged to a stand pipe 18 or feed chute, and one wash press—stand pipe combination (FIG. 3), where the dilution 16''' of the fibre suspension takes place simultaneously with the entrance of the fibre suspension into the stand pipe 18. Here, a twin-roll wash press is shown as an example of various applicable washing and thickening devices. There are numerous other devices that may be used for the same purpose, like a single roll wash press, drum filter, DrumDisplacer™ washer, a screw press, etc. A twin-roll press 10 receives the fibre suspension to be treated along one or more inlet conduits 12. Other washing and filtering devices have their own arrangements for receiving the fibre suspension. After having been washed and pressed between the rolls the thickened fibre suspension or pulp is discharged from the wash press 10 by means of a discharge screw 14, which is positioned typically at the top part of the washer such that the discharge screw 14 moves the thickened pulp axially to the end of the wash press 10 to a dilution means 16' or 16" (FIGS. 1 and 2) arranged to the same level, floor or storey with the wash press. However, in practice all present day dilution means are arranged on the floor level of the wash press 10 or lower. In other words, the process device may be on the second floor, and the dilution means on the first or on the second floor. This means that the pulp discharged from the wash press is moved a couple of meters (corresponding to the structural height of the process device) or more down to the dilution means. In the dilution means 16' or 16" the consistency of the washed or thickened fibre suspension is decreased down to 8-14%. Thereafter the dilution means 16' or 16" discharges the pulp to an upright stand pipe 18 the lower end, or bottom part, of which is provided with an outlet opening 20. A pump, preferably, but not necessarily, a centrifugal pump 22 is either directly or by means of an inlet conduit arranged in flow communication with the outlet opening 20 for taking the diluted pulp, i.e. the process liquid further to a subsequent process step, which may include bleaching, screening, washing, web formation or storage, just to name a few options.

The dilution of pulp or fibre suspension after the washing and thickening devicethickening device 10 may be performed by means of the discharge screw 14 of the washing and thickening device 10, a separate dilution screw 16' having dilution liquid introduction means D (FIG. 1), a separate mechanical dilution apparatus 16" having dilution liquid introduction means D (FIG. 2) or the dilution means may be one or more dilution liquid conduits or nozzles arranged, in practice, immediately after the discharge screw 14 of the washing and thickening device 10, or the dilution liquid may be injected by means of nozzles 16''' into the upper end of the stand pipe where the thick fibre suspension is entering (FIG. 3). Thus the pulp is, in accordance with all prior art teachings, diluted in advance of its entrance on the pulp column in the stand pipe or feed chute 18. As already mentioned above in connection with the discussion relating to the wash press, the dilution means are normally arranged at a lower level than the means discharging the thickened process liquid from the washing and thickening device. This means, in practice, that it is the height of the discharge of the dilution means that can be the maximal height of the stand pipe. Thus, it is understandable that the washing, thickening and filtering means is arranged on the second or third floor at the mill.

The stand pipe 18 is typically provided with means 24 for measuring the surface level of the diluted pulp in the stand pipe. The surface level of the diluted pulp in the stand pipe, when in use, is maintained between predetermined upper and lower limits, i.e. within a so called control range. The means 24 for measuring the surface level of the pulp comprises a surface level indicator system having an upper surface level control limit 26 and a lower surface level control limit 28. It is worthwhile noticing that there is a number of applicable prior art surface level measuring means 24. In addition to ordinary gauge systems, the height or the level of the process liquid, i.e. pulp may be measured by indirect methods, too, for instance by process tomography or gamma-ray method. An applicable surface level measuring arrangement that utilizes tomography has been discussed, for instance, in WO-A1-09019150.

As solutions to the problems discussed above several ways are suggested in the following. The first and easiest way to improve the positioning of the washing and thickening device in relation to the stand pipe is to arrange the discharge of the washing and thickening device to take place directly to the stand pipe, i.e. without taking the process liquid first down and then introducing it into the stand pipe. Another way is to arrange the discharge of the process liquid from the washing and thickening device to be taken care of by means of an inclined discharge means, for instance an inclined screw feeder that takes the process liquid upwards to the upper end of the stand pipe. And a third way is to adjust the consistency of the process liquid in the stand pipe such that the height of the level control range in the stand pipe may be decreased. The above discussed three ways may be used together or in any combination of two ways, or any one of the three ways may be used alone to fulfil at least one object of the present invention. It is clear that each one of the above discussed ways decreases the required height difference between the washing and thickening device and the stand pipe.

Figure 4:
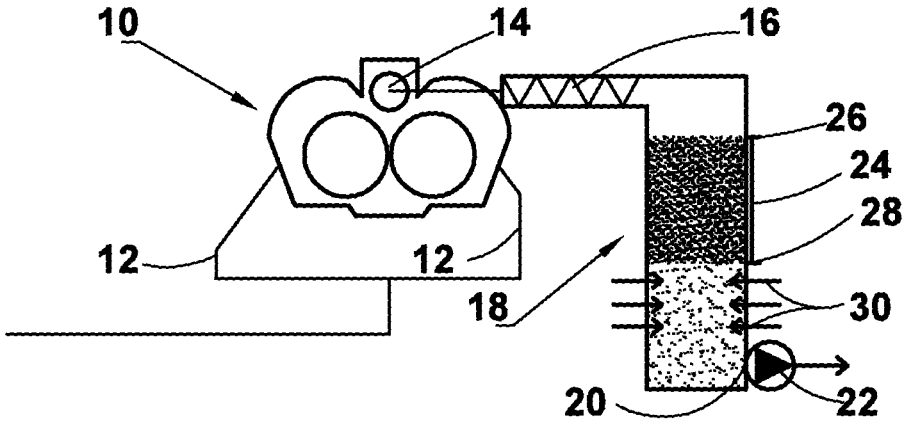
FIG. 4 illustrates a novel arrangement for transferring pulp from a washing and thickening apparatus to a stand pipe in accordance with a first preferred embodiment of the present invention.

FIG. 4 illustrates an arrangement for transferring a process liquid from the washing and thickening device to a subsequent process stage in accordance with a first preferred embodiment of the present invention. Here, a wash press 10 is used as an example of various possible washing, filtering and thickening device. As already shown in FIGS. 1, 2 and 3 the discharge screw 14 of the wash press 10 is arranged at the top part of the wash press, i.e. a few meters above the installation level of the washing and thickening device, i.e. at a height corresponding to the structural height of the washing and thickening device. FIG. 4 shows schematically that the discharge screw 14 feeds the thickened pulp at a consistency of 20-50%, usually between 25 and 40%, to another feed screw 16 for discharging the thickened process liquid, i.e. pulp further to the stand pipe 18 that is arranged at a side of the wash press 10. The other feed screw 16 may be horizontal as shown in FIG. 4, whereby the structural height of the washing and thickening device is taken in full use. Another option is to arrange the feed screw to be inclined such that it takes the process liquid from the washing and thickening device upwards to the upper end of the stand pipe. It is also possible that the discharge screw 14 (or its extension) of the wash press 10 itself feeds the thickened process liquid to the stand pipe 18, in which case the stand pipe is positioned at an axial end of the wash press 10. What makes this embodiment of the present invention, as well as the following embodiments of the present invention, different from the prior art is the positioning of the stand pipe 18 in relation to the washing and thickening device 10. Now the mutual positioning of the stand pipe 18 and the wash press has been changed radically. The wash press 10 has been brought down to the side of the stand pipe 18, i.e. the wash press 10 is preferably arranged substantially on the same level or floor with the stand pipe 18, or at most to a level of about 5 meters above the bottom level of the stand pipe 18. As usual the lower end of the stand pipe 18 is provided with an outlet 20 and a pump, preferably but not necessarily, a centrifugal pump 22 arranged in flow communication with the outlet 20 for transferring the diluted process liquid/fibre suspension further in the process.

The stand pipe or feed chute 18 is provided with means 24 for measuring the surface level of the process liquid, i.e. pulp in the stand pipe 18, and means 30 for diluting the pulp in the stand pipe 18. Since an object of the present invention is to lower the surface level control range of a stand pipe as much as possible, it means, in practice, that the consistency (or, to be specific, the average consistency) of the fibre suspension within the surface level control range should be maintained as high as possible. The average consistency may, for instance, be determined by calculating the effect of dilution liquid added to the process liquid either above the lower limit of the surface level control range or within the surface level control range in the stand pipe. To be able to perform the calculation the consistency C and the volume flow $Q_p$ of the process liquid entering the stand pipe should be known. I.e. $Q_p$*C gives the amount (volume flow) of dry matter entering the stand pipe. Thereafter each time a certain amount (volume flow $Q_{d1}$) of dilution liquid is added to the process liquid, the consistency of the process liquid is calculated as follows $C_1=Q_p*C/(Q_p+Q_{d1})$. This will be the consistency of the process liquid as long as dilution liquid is again added somewhere lower in the stand pipe. Next the height difference $h_1$ between the two addition points is measured whereby also the volume $V_1$ of the process liquid having a consistency of $C_1$ is known, i.e. $V_1=A*h_1$, where A is the cross sectional flow area of the stand pipe. The same calculations are repeated for the second addition of dilution liquid $Q_{d2}$. The consistency of the process liquid below the second point of addition is $C_2=Q_p*C/(Q_p+Q_{d1}+Q_{d2})$. When the next (third) point of addition of dilution liquid or the lower limit of the surface level control range is reached the second height $h_2$ may be measured, whereby the volume $V_2$ of the process liquid having a consistency of $C_2$ is known, i.e. $V_2=A*h_2$. The corresponding calculations are continued as long as there are dilution liquid introduction points or levels above the lower limit of the surface level control range. If the lower level of the surface level control range was reached, the average consistency $C_a$ above the lower level may be calculated as follows $C_a=(V_1*C_1+V_2*C_2)/A*(h_1+h_2)=(h_1*C_1+h_2*C_2)/(h_1+h_2)$. In other words, the average consistency is the division of the sum of each individual consistency multiplied with the height of the constant consistency area and the height calculated from the lower level of the surface level control range up to the first (uppermost) addition point of the dilution liquid. The above explanation just gives an exemplary idea how the average consistency may be determined. There may be other options. For instance, it is possible to determine the consistency after the addition of the dilution liquid by some other means, i.e. by means of a rotating rotor or by process tomography, whereby the consistency values need not be calculated.

Thus, to ensure the best controllability of the surface level or the highest possible consistency in the surface level control range, the dilution means should be positioned below the lower limit 28 of the surface level control range. Also the dilution means should be designed, positioned and dimensioned so that the process liquid is as homogenous as possible in view of consistency when entering the discharge of the stand pipe. In practice this means that the dilution liquid should be divided as evenly as possible to the entire cross section of the stand pipe. This may be accomplished by spreading the dilution liquid evenly to the entire cross section each time the dilution liquid is added or by arranging the dilution liquid introduction means on different levels of the stand pipe such that their combined effect is even enough. However, in case maximum controllability or consistency is not needed, at least a part of the dilution may be performed within the surface level control range or even above it. Thus, an essential feature of the present invention is that the average consistency of the pulp (so called third consistency) in the surface level control range or above the lower limit of the surface level control range should be at least 1,5-2,0 times higher than the pumping consistency, i.e. the consistency (so called second consistency) to which the pulp is finally diluted in the bottom part of the stand pipe 18. Thus, there are means for feeding dilution liquid to the process liquid at and/or below the surface level control range, the dilution liquid fed by the feeding means having a volume flow sufficient for reducing the consistency of the process liquid to the pumping consistency, i.e. the third consistency in the surface level control range is at least 1,5-2 times the discharge consistency. In other words, here it is a question of lowering the consistency of the process liquid from one consistency level to another lower consistency level, i.e. for instance from HC consistency (above 18%) to MC consistency (above 8% or between 6-15%).

As a brief example of a washing and thickening device a wash-press may be discussed. The ordinary discharge consistency of a wash press i.e. the first consistency is usually above 25%, and the required pumping consistency at the bottom part of the stand pipe, i.e. the second consistency above 8-9%, up to 14-15%. Thus the average consistency in the surface level control range in the stand pipe is, in accordance with the present invention, roughly about 13% or more. By means of the above described arrangement it is possible to decrease significantly the height requirement of the control range. For instance if we want that a certain absolute amount of pulp (solid matter) is present in the control range, and the control range has been 1,5 meters when the pulp is in 9% consistency, the required height of the control range is 1,04 meters if the pulp is in 13% consistency, or the height is 0,75 m if the pulp is in 18% consistency. In other words, by doubling the consistency the required height of the control range may be halved.

It means that the dilution means 30, when in use, is dimensioned and positioned such that either a substantially small share of the dilution liquid is introduced into the fibre suspension in the surface level control range or above it, or there is, for the most part of the surface level control range between the upper and lower limits 26 and 28, non-diluted, i.e. thickened pulp received in thickened state, i.e. at a so called first consistency from the preceding washing and thickening device (here the wash press). Preferably, the above target is reached when the dilution means is positioned such that most of the dilution liquid introduction takes place below the lower limit 28 of the surface level control range. An option is to locate the dilution means as low in the surface level control range between the upper and lower control limits 26 and 28 as possible, preferably entirely below the lower surface level control limit 28, whereby the surface level measuring means follow, at least mainly, the changes in the surface level of the non-diluted pulp. This, naturally, means in practice that, preferably but not necessarily, the entire dilution means 30 is arranged below the lower surface level limit 28.

The construction of the dilution means 30 of this embodiment of the present invention has a few options. For instance, the dilution means 30 may be a set of nozzles arranged on the periphery of the stand pipe 18, possibly there may be more than one set of nozzles, i.e. two or more sets of nozzles, one above the other, or the dilution means 30 may be a set of injection pipes arranged to run across the stand pipe 18. To ensure homogenized dilution and thereby reliable and trouble-free pumping of the fibre suspension, the injection from the nozzles or pipes should be performed such that the injected jets of dilution liquid penetrate deep into the fibre suspension in the stand pipe, and cover essentially the whole cross section of the stand pipe. In case injection pipes arranged across the stand pipe are used, the pipes and their injection nozzles should be positioned such that the injection sprays, again, cover essentially the entire cross section of the stand pipe. The dilution liquid to be fed into the thick fibre suspension may be at elevated temperature, if the pulp needs to be heated. The dilution liquid may be water, filtrate or any applicable liquid that possibly contains at least one additive or chemical, e.g. for simultaneous regulation of the pH value of the process liquid.

The above discussed upper and lower limits of the surface level measuring means need not to be individual, physical limit switches but they may be set points in a surface level measurement/control system. In practise this means that the actual range of the surface level measurement utilised by the system may be wider than the range between the upper and lower limits, i.e. the surface level control range. However, the surface level control is made easier if the inlets for dilution liquid, i.e. the dilution of the process liquid is arranged below the lower level limit.

The arrangement shown in FIG. 4 operates so that the pulp is first introduced into the washing and thickening device 10 along one or more conduits 12.

The pulp is treated in the washing and thickening device. The thickened pulp is introduced from the washing and thickening device 10 in a first consistency, say about 20% or more, into the stand pipe 18 by means of the discharge screw 14 of the washing and thickening device 10, possibly with the help of another screw feeder 16. Here it should be understood that the other screw feeder may not only be horizontal, but also inclined screw feeders may be used. Thus, by arranging the screw feeder to incline upwardly, it moves the pulp upwards towards the stand pipe, whereby the washing or thickening device may, again, be brought to a lower level. The consistency of the pulp is preferably maintained substantially unchanged in the upper part of the stand pipe 18, i.e. in the top part of the stand pipe 18 and in the upper part of the level control range between the upper and lower limits, 26 and 28, respectively, and even more preferably above the lower limit 28.

Thus, the thickened pulp is preferably subjected to injection of dilution liquid at the lower part of the control range, and more preferably entirely below the lower control limit 28, i.e. typically water or some other dilution liquid is introduced into the pulp so that the pulp in the lower part of the stand pipe is diluted. Thereby, the consistency of the pulp is decreased typically to a second consistency, to a level of above 8%, preferably between 8-15%, i.e. to the range of pumpable MC-pulp. Since the consistency of the process liquid in the upper part of the stand pipe, i.e. at the top part of the stand pipe and in the upper part of the level control range, preferably entirely above the lower limit 28 of the level control range, is maintained considerably high, it is possible to shorten (to reduce the height of) the control range significantly from that of prior art where the control took place by following the level changes of diluted pulp. For instance, if the consistency of thickened pulp, i.e. the first consistency is 21% and that of the diluted pulp, i.e. the second consistency 7%, the prior art required three times longer/higher control range or height than the arrangement of the present invention, when the dilution of the pulp in the present invention takes place totally below the lower control limit. In this manner, the stand pipe or at least its surface level control range may be made significantly lower in comparison to prior art stand pipes. Or, if the dimensions of the stand pipe are maintained, the residence time for controlling the operation of the stand pipe or pumping is tripled. Further, the stand pipe may be operated as buffer storage for diluted pulp, though only the lower part of the stand pipe contains diluted pulp. An obvious feature of this embodiment of the present invention, which has no rotary mixing means for the dilution liquid, is that it is the centrifugal pump that further homogenizes and mixes the dilution liquid with the pulp. The pump 22 discharges the pulp to further processing.

Figure 5:
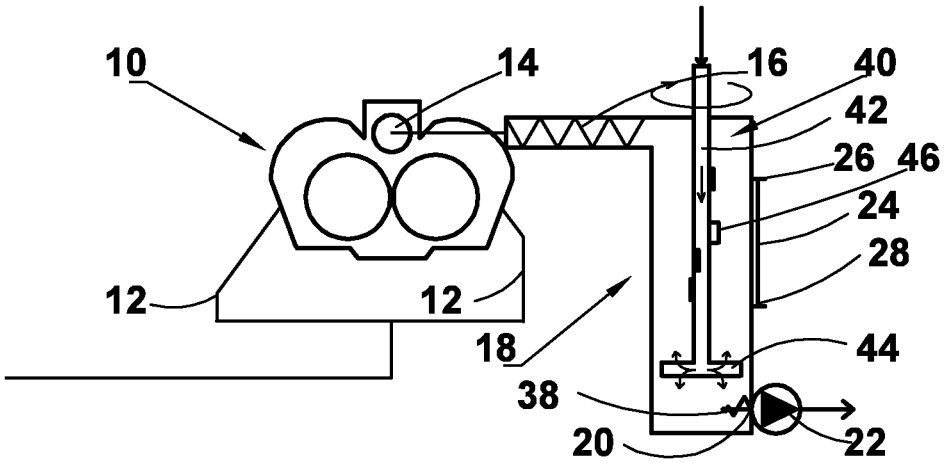
FIG. 5 illustrates a novel arrangement for transferring pulp from a washing and thickening apparatus to a stand pipe in accordance with a second preferred embodiment of the present invention.

FIG. 5 illustrates an arrangement for transferring a process liquid from washing and thickening device to a subsequent process stage in accordance with a second preferred embodiment of the present invention. This embodiment corresponds to the embodiment of FIG. 4 except for a different method of diluting the pulp. The present embodiment shows, in fact, two also separately applicable devices. To start with, the pump 22 is provided with a pulp fluidizing means 38 at its inlet, preferably extending in the outlet opening 20 of the stand pipe 18, and possibly inside the stand pipe 18, too. This kind of a fluidization device may be used in combination with any dilution means, i.e. not only with that of this second embodiment. In the arrangement of FIG. 5 the dilution liquid is, as in the earlier embodiment, introduced into the pulp below the surface of the pulp in the stand pipe 18, when in operation. The dilution liquid is brought into the lower part of the stand pipe 18, i.e. into the lower part of the level control range between the upper and lower control limits, 26 and 28, respectively, preferably totally below the surface level control range by means of a pipe 42. In this embodiment the pipe forms a shaft 42 of a vertical mixer 40 having an axial conduit for bringing the dilution liquid to the lower part of the stand pipe 18. The pipe or shaft 42 itself may be provided with one or more nozzles or feed openings at its lower end for injecting the dilution liquid into the pulp and one or more blades 44 or paddles for spreading and mixing the dilution liquid with the pulp to the entire cross section of the stand pipe. The blades or paddles 44 may be arranged, if desired, to feed the fibre suspension towards the discharge outlet opening 20 of the stand pipe 18. At least a part of the one or more nozzles or feed openings for the dilution liquid may also be arranged in the one or more blades/paddles 44. The pipe or shaft 42 may extend into the stand pipe 18 either from above or through the bottom of the stand pipe 18. The pipe or shaft 42 may have dilution liquid feed openings or nozzles along its entire length, but the nozzles or openings feeding the dilution liquid for the main dilution are located below the lower limit 28 of the surface level control range.

The shaft 42 extending through the thickened pulp in the upper part of the stand pipe 18 may be provided with one or more additional blades 46 along its length, which are mainly utilised when measuring the surface level of the pulp in the stand pipe 18. In practice such is performed by means of monitoring the power required to rotate the shaft 42. Additionally, the blades 46 may be arranged to feed the fibre suspension towards the discharge outlet opening 20 of the stand pipe 18.

The entrance of thickened pulp into the stand pipe 18 is shown schematically to take place by means of a screw feeder 16 extending into the stand pipe 18. The actual inlet into the stand pipe 18 may be arranged with an opening in the side wall or in the top cover of the stand pipe 18. The screw feeder may be not only horizontal but also inclined, possibly upwards.

In view of above it should also be understood that the teachings of FIG. 4 and FIG. 5 may be combined in a few appropriate ways. Firstly, it is possible to introduce dilution liquid into the stand pipe as an alternative or in addition to the nozzles arranged along the periphery through the wall of the stand pipe also through one or more dilution liquid pipes extending into the lower part of the stand pipe either from above, through the side wall or through the bottom of the stand pipe. The part of the pipe/s located in the lower part of the stand pipe, i.e. in a so called dilution zone is provided with one or more nozzles or feed openings for injecting dilution liquid in the pulp. Secondly, the above discussed dilution means may be provided with separate mixing means extending into the dilution zone from above, from below, or through the side wall of the stand pipe. Thirdly, the embodiment of FIG. 4 may be provided with the above discussed separate mixing means.

Figure 6:
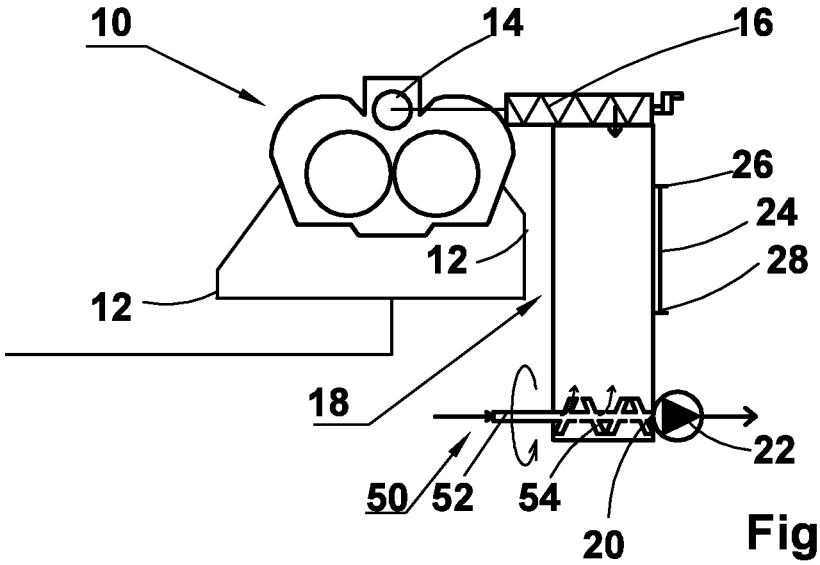
FIG. 6 illustrates a novel arrangement for transferring pulp from a washing and thickening apparatus to a stand pipe in accordance with a third preferred embodiment of the present invention.

FIG. 6 illustrates an arrangement for transferring a process liquid from washing and thickening device to a subsequent process stage in accordance with a third preferred embodiment of the present invention. This embodiment corresponds closely to those of FIGS. 4 and 5 except for the dilution liquid introduction and mixing means. In the embodiment of FIG. 6 the dilution liquid is, again, introduced into the pulp below the surface of the pulp, more preferably, below the lower control limit 28, in the stand pipe 12, when in operation. In this embodiment the stand pipe 18 is provided, preferably near its bottom, with a substantially horizontal rotary mixer 50, which operates also as means for introducing dilution liquid. For such a purpose the mixer 50 is provided with a hollow shaft 52 having an axial conduit for dilution liquid, and one or more paddles 54 for mixing the dilution liquid with pulp. The actual introduction of the dilution liquid into the pulp is arranged via one or more injection nozzles or feed openings provided in the mixer shaft 52, in the one or more mixer paddles 54 or in both. Naturally, it is also possible to bring dilution liquid into the stand pipe either alone or together with the openings/nozzles in the rotary mixer 50 by some other means like injectors extending through the stand pipe walls (FIG. 4), or pipes extending into the lower part of the stand pipe (FIG. 5). The mixer 50 may, if desired, be designed so that it also acts as a conveyor or a feeder transporting pulp towards the outlet 20 of the stand pipe 18. In view of the above it should also be understood that the mixer 50 need not necessarily be horizontal, but also inclined mixers will do. Also, the pump 22 may be provided with a fluidization device discussed in connection with FIG. 4. And finally, the rotary mixer 50, too, may be used for fluidizing the pulp.

Figure 7:
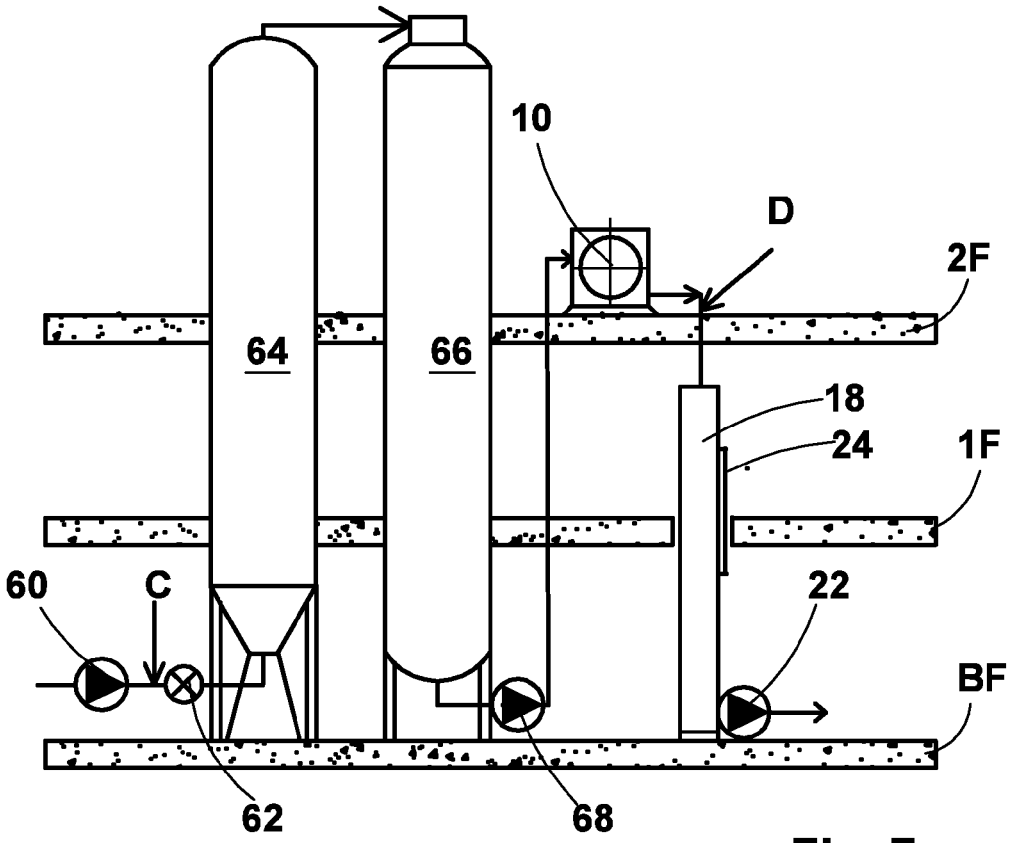
FIG. 7 illustrates a pulp bleaching and washing stage utilising a prior art arrangement for transferring a process liquid.
Figure 8:
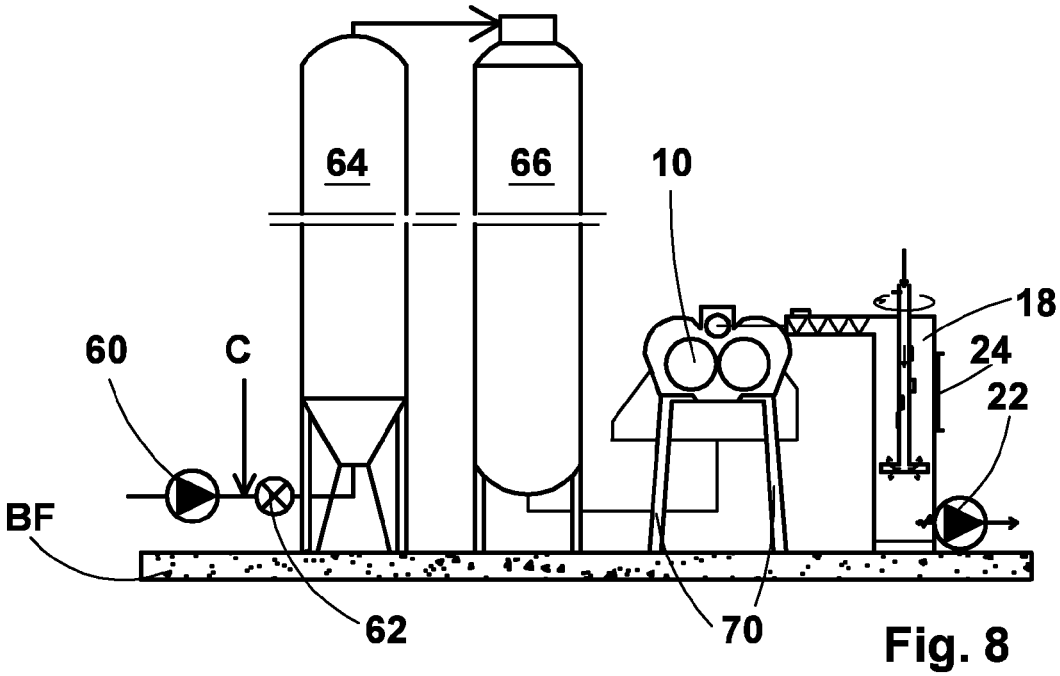
FIG. 8 illustrates a pulp bleaching and washing stage employing the process liquid transferring arrangement of the present invention.

FIGS. 7 and 8 illustrate a comparison between a bleaching stage of prior art (FIG. 7) and a bleaching stage utilizing the arrangement of the present invention (FIG. 8). A bleaching stage, not specified in any more detailed manner, may be considered to start with pumping pulp from an earlier process stage towards a bleaching tower 64 by means of a pump 60. Chemical C is mixed with the pulp by means of a mixer 62. The pulp is taken thereafter to a bleaching tower 64, and from the bleaching tower 64 to a storage tower or blow tank 66 that may act as a vessel for giving the chemical C sufficient time for reactions with the fibre suspension. The blow tank 66 after the bleaching tower may have a substantially small diameter (contrary to what is illustrated in FIG. 7) if there is no need for arranging any retention time in the blow tank but it is used as a lengthy stand pipe extending from the top level of the bleaching tower 64 down to the bottom or ground floor BF of the building. From the storage tower/blow tank 66 the pulp is discharged to a pump 68 that transfers the pulp up to a washing and thickening device 10 positioned on the first floor 1F or on the second floor 2F of the building. Thereafter the prior art arrangement functions in the manner discussed in connection with FIGS. 1, 2 and 3.

In the arrangement of the present invention disclosed in FIG. 8, the process flow is substantially similar to that illustrated in FIG. 7 except for the transfer of pulp from the storage tower/blow tank 66 to the washing and thickening device 10 and the positioning of the washing and thickening device 10 in relation to the stand pipe 18. The arrangement of the invention makes it possible to transfer the pulp from the storage tower/blow tank 66 directly to the washing and thickening device 10 without pumping, i.e. by utilizing the head of pulp in the storage tower/blow tank 66. In other words, in spite of the flow or pressure loss in the discharge of the storage tower/blow tank 66, in the pipeline between the storage tower 66 and the washing and thickening device 10 and in the feed of the washing and thickening device 10, the head of pulp in the storage tower 66 is sufficient for introducing pulp into the washing and thickening device 10. As can be seen the washing and thickening device 10 is so close to the bottom end of the blow tank, i.e. the ground floor BF that it may supported on the ground floor BF by means of a supporting structure 70, whereby there is no need for the first and second floor in the bleaching plant as shown in prior art FIG. 7. A further alternative is to arrange the storage tower/blow tank to have a bottom substantially at the height or level of the washing and thickening device, or rather at the height or level of the inlet/s to the washing and thickening device. Thus, it is clear that in such a case the process liquid is not taken down to the bottom level BF as shown in FIG. 8, but is directly discharged from the storage tower/blow tank to the washing and thickening device. In this option the storage tower/blow tank may, if desired, have a reduced diameter, too, whereby it may be called a stand pipe.

As a practical example a stand pipe could be discussed into which pulp is discharged from a wash press at a consistency of 25%. The pump used for discharging the stand pipe requires an inlet head of at least 5 meters and a consistency of 9%. In a prior art arrangement the stand pipe has a height of 7 meters, i.e. 5 meters for the inlet head, 1,5 meters for the level control range and 0,5 meters for the introduction of pulp into the stand pipe. The dilution means, which are arranged above the stand pipe on the same floor with the washing and thickening device, needs an additional height of 1-2 meters. Thereby the floor on which the dilution means and the washing and thickening device are is about 8-10 meters above the ground floor. By using the principles of the present invention, the inlet head of the pump is the same i.e. 5 meters, but the height of the control range may be decreased to 0,75 meters by using a higher (about 18%) consistency in the level control range. Thus the pulp could be introduced into the stand pipe at a height of 5,75 meters. Now, if the discharge screw of the wash press is 2,5 meters above the installation level of the wash press, the installation level of the wash press is about 3,25 meters above the bottom level of the stand pipe. And, if the introduction of pulp into the stand pipe is done by means of an inclined screw feeder, it is easy to bring the wash press still lower, to a height of about 2-2,5 meters, for instance. Thus, by utilizing the principles of the present invention the layout of the plant may be changed significantly, as the washing and thickening device does not need any additional floors, but may be supported on top of legs having a height of a few meters. Such a construction allows, for instance the positioning of filtrate tanks immediately below the washing and thickening device on the ground floor.

The present invention may also be used in a wide variety of applications outside the pulp and paper industry, which is discussed above as an example only. The other applications include, without any limitation, biomass treatment and bio fuel production. In such processes the feedstock need to be pre-treated or hydrolyzed whereby filtering and thickening and subsequent pumping are required. Such a feedstock may be for example grass, straw, bagasse, wood, bark, corn stems, etc.

It is clear that the invention is not limited to the examples mentioned above but can be implemented in many other different embodiments within the scope of the inventive idea. It is also clear that the features in each embodiment described above may be used in connection with the other embodiments whenever feasible. It should also be understood that the ideas of determining the average consistency as well as the uniform enough mixing of the dilution liquid to the entire cross section of the stand pipe above the stand pipe discharge may be applied in connection with all embodiments of the present invention in spite of the fact that they may have been discussed in connection with one embodiment.

The invention claimed is:

1. A method of transferring a fiber suspension from a washing and thickening device to a subsequent process stage, the method comprising the steps of:

discharging the fiber suspension in a consistency of 20-50% from a washing and thickening device, taking the fiber suspension to a stand pipe, diluting the fiber suspension to a second consistency, i.e. to a MC-consistency, providing the stand pipe with means for measuring the surface level of the fiber suspension in the stand pipe, the measuring means having a surface level control range with an upper surface level control limit, and a lower surface level control limit for maintaining, when in use, the surface level of the fiber suspension between the upper and the lower surface level control limits, discharging the fiber suspension in the second consistency from said stand pipe by means of a pump arranged in flow communication with a discharge outlet opening provided in the stand pipe, characterized by the further step of providing the fiber suspension in the surface level control range in the stand pipe with an average consistency, i.e. a third consistency, the third consistency being at least 1.5 times the second consistency.

2. The method as recited in claim 1, wherein the third consistency is at least 2 times the second consistency.

3. The method as recited in claim 1, characterized by performing the dilution of the fiber suspension to the second consistency in the stand pipe below the lower surface level control limit of the surface level control range.

4. The method as recited in claim 3, characterized by performing the dilution by means of one of a rotary device having one or more blades or paddles and a rotary device feeding the fiber suspension towards the discharge outlet opening.

5. The method as recited in claim 4, characterized in that the surface level measuring means are one of a rotary device having one or more blades within the surface level control range, gamma ray and process tomography.

6. The method as recited in claim 1, wherein the second consistency is between 6 and 15%.

7. The method as recited in claim 1, characterized by at least one of heating the fiber suspension by means of the dilution liquid and adding a chemical to the fiber suspension by means of the dilution liquid.

* * * * *